US010865027B2

(12) United States Patent
Hall et al.

(10) Patent No.: US 10,865,027 B2
(45) **Date of Patent: *Dec. 15, 2020**

(54) PACKAGES CONTAINING A FOOD PRODUCT AND METHODS OF OPENING

(71) Applicant: Intercontinental Great Brands LLC, East Hanover, NJ (US)

(72) Inventors: Isabel Hall, East Hanover, NJ (US); Justin Burns, East Hanover, NJ (US); Mark Kansburg, East Hanover, NJ (US); Robert Sosnowski, East Hanover, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/524,560

(22) Filed: Jul. 29, 2019

(65) Prior Publication Data

US 2020/0017270 A1 Jan. 16, 2020

Related U.S. Application Data

(63) Continuation of application No. 15/517,023, filed as application No. PCT/US2015/054415 on Oct. 7, 2015, now Pat. No. 10,407,229.

(Continued)

(51) Int. Cl.
*B65D 75/58* (2006.01)

(52) U.S. Cl.
CPC ..... *B65D 75/5827* (2013.01); *B65D 75/58* (2013.01); *B65D 75/585* (2013.01)

(58) Field of Classification Search
CPC ... B65D 75/58; B65D 75/5827; B65D 75/585

(Continued)

(56) References Cited

U.S. PATENT DOCUMENTS 3,379,360 A 4/1968 Crossley
4,290,526 A 9/1981 Haiss (Continued)

FOREIGN PATENT DOCUMENTS

AU 2002211112 6/2008
BR 9103448 5/1992

(Continued)

OTHER PUBLICATIONS

IP Australia Office, Patent Examination Report No. 1 dated Oct. 20, 2017, Australian Application No. 2015328139; (4 pgs.).

(Continued)

*Primary Examiner* — Rafael A Ortiz
(74) *Attorney, Agent, or Firm* — Fitch, Even, Tabin & Flannery LLP

(57) ABSTRACT

A package containing a food product is provided where the package is configured to facilitate opening by using the food product to initiate opening of the packages. The package includes an outer wrapper with a line of weakness that is generally aligned with or above an upper profile of the food product such that when the wrapper is pulled against the food product one or more stress concentrations is created along the line of weakness due to the profile of the food product, whether in direct or near direct contact with the line of weakness of by the food product spacing front and rear walls of the wrapper apart during opening. The stress concentrations facilitate initiation of tearing or rupturing along the line of weakness such that a portion of the package can be completely or at least partially removed to expose at least a portion of the food product.

2 Claims, 11 Drawing Sheets

Related U.S. Application Data

(60) Provisional application No. 62/062,080, filed on Oct. 9, 2014.

(58) Field of Classification Search
USPC ..... 206/551, 495, 800, 830, 208; 383/207; 229/87.07, 87.09, 87.11; 426/122, 124, 426/106
See application file for complete search history.

(56) References Cited

U.S. PATENT DOCUMENTS

| | | | | |
|---|---|---|---|---|
| 5,380,094 | A | 1/1995 | Schmidt | |
| 5,437,881 | A | 8/1995 | Jeannin | |
| 5,505,370 | A | 4/1996 | Brown | |
| 5,809,568 | A | 9/1998 | Morris-Jones | |
| 6,173,554 | B1 | 1/2001 | Marbler | |
| 6,767,604 | B2 | 7/2004 | Muir, Jr. | |
| 6,955,665 | B2 | 10/2005 | Domeier | |
| 7,331,153 | B1 | 2/2008 | Sperry | |
| 7,862,841 | B1 * | 1/2011 | Boyd | B65D 1/02 206/217 |
| 8,506,165 | B2 * | 8/2013 | Shinozaki | B65D 75/585 229/87.05 |
| 2002/0182359 | A1 | 12/2002 | Muir, Jr. | |
| 2003/0019780 | A1 * | 1/2003 | Parodi | B65D 75/5827 206/524.1 |
| 2003/0116453 | A1 | 6/2003 | Russo | |
| 2003/0123760 | A1 | 7/2003 | Olin | |
| 2005/0136156 | A1 | 6/2005 | Barr | |
| 2005/0218028 | A1 | 10/2005 | Vestal | |
| 2007/0063008 | A1 | 3/2007 | El-Afandi | |
| 2008/0170814 | A1 * | 7/2008 | Bowers | B65D 33/30 383/204 |
| 2008/0179384 | A1 | 7/2008 | Diaz De La Rocha | |
| 2009/0101529 | A1 | 4/2009 | Gelardi | |
| 2012/0000969 | A1 | 1/2012 | Rehkugler | |
| 2012/0263834 | A1 * | 10/2012 | Aldridge | B65D 85/60 426/115 |
| 2014/0001250 | A1 | 1/2014 | Fisher | |
| 2014/0084004 | A1 | 3/2014 | Kanderka | |
| 2014/0151260 | A1 * | 6/2014 | Frank | B65D 31/16 206/524.5 |
| 2017/0297800 | A1 | 10/2017 | Hall | |

FOREIGN PATENT DOCUMENTS

| | | |
|---|---|---|
| BR | 9912302 | 4/2001 |
| BR | 0106175 | 9/2003 |
| BR | 0106521 | 9/2003 |
| CA | 2019915 | 2/2000 |
| CA | 2307368 | 11/2000 |
| CA | 2687847 | 6/2011 |
| CH | 638746 | 10/1983 |
| CN | 1535234 | 10/2004 |
| CN | 1564770 | 1/2005 |
| CN | 1732118 | 2/2006 |
| CN | 101142128 | 3/2008 |
| CN | 101875415 | 11/2010 |
| CN | 102917962 | 2/2013 |
| CN | 104822598 | 8/2015 |
| DE | 2840409 | 4/1980 |
| DE | 8904192 | 7/1989 |
| DE | 29509593 | 9/1995 |
| DE | 4426760 | 1/1996 |
| DE | 29718757 | 1/1998 |
| DE | 20305447 | 6/2003 |
| DE | 202011100666 | 7/2011 |
| EP | 0579030 | 1/1994 |
| EP | 0471211 | 1/1995 |
| EP | 0406613 B1 | 3/1995 |
| EP | 0957043 | 11/1999 |
| EP | 1449788 | 8/2004 |
| EP | 1477425 | 11/2004 |
| EP | 1595821 | 11/2005 |
| EP | 1834893 | 9/2007 |
| EP | 1834893 B1 | 6/2009 |
| EP | 2284096 | 2/2011 |
| EP | 2484603 | 12/2013 |
| EP | 3204312 | 8/2017 |
| ES | 2020485 | 8/1991 |
| GB | 2268723 | 1/1994 |
| GB | 2441320 | 3/2008 |
| JP | H02282055 | 11/1990 |
| JP | H0343375 | 2/1991 |
| JP | H0891430 | 4/1996 |
| JP | H09142523 | 6/1997 |
| JP | 2000062801 | 2/2000 |
| JP | 2000203600 | 7/2000 |
| JP | 2001031114 | 2/2001 |
| JP | 2001055247 | 2/2001 |
| JP | 2001055248 | 2/2001 |
| JP | 2001106240 | 4/2001 |
| JP | 2002193276 | 7/2002 |
| JP | 04066505 | 3/2008 |
| JP | 2008189324 | 8/2008 |
| JP | 2011255913 | 12/2011 |
| JP | 2012148816 | 8/2012 |
| JP | 2013209130 | 10/2013 |
| WO | 9404330 | 3/1994 |
| WO | 9504709 | 2/1995 |
| WO | 1999062773 | 12/1999 |
| WO | 0059801 | 10/2000 |
| WO | 2002090196 | 11/2002 |
| WO | 2004110880 | 12/2004 |
| WO | 2005068318 | 7/2005 |
| WO | 2007065774 | 6/2007 |
| WO | 2008029106 | 3/2008 |
| WO | 2009090930 | 7/2009 |
| WO | 2011071824 | 6/2011 |
| WO | 2012032327 | 3/2012 |
| WO | 2013064375 | 5/2013 |
| WO | 2014060795 | 4/2014 |
| WO | 2016057627 | 4/2016 |

OTHER PUBLICATIONS

Canadian Patent Office, Office Action dated Apr. 10, 2019, Canadian Application No. 2,956,327 (3 pgs.).

Canadian Patent Office, Office Action dated Mar. 19, 2018, Canadian Application No. 2,956,327 (3 pgs.).

European Patent Office, Extended European Search Report dated Nov. 30, 2018, European Application No. 18202217.8 (8 pgs.).

International Search Report and Written Opinion of the International Searching Authority, dated Dec. 7, 2015 for International Application No. PCT/US2015/054415 (9 pgs.).

The State Intellectual Property Office of P. R. China, Notification of the First Office Action, dated Jul. 3, 2018, China Application No. 201580052285.6, with English translation (13 pgs.).

The State Intellectual Property Office of P. R. China, Notification of the Second Office Action dated Feb. 2, 2019, China Application No. 201580052285.6 (12 pgs.).

* cited by examiner

PACKAGES CONTAINING A FOOD PRODUCT AND METHODS OF OPENING

CROSS REFERENCE TO RELATED APPLICATIONS

This application is a continuation of U.S. application Ser. No. 15/517,023, filed Apr. 5, 2017 and now U.S. Pat. No. 10,407,229, issued Sep. 10, 2019, which is a U.S. national phase application of International Application No. PCT/US2015/054415, filed Oct. 7, 2015, which claims benefit from U.S. Provisional Application No. 62/062,080, filed Oct. 9, 2014, which are each hereby incorporated herein by reference in their entirety.

FIELD

Packages containing a food product and methods of opening are described herein and, in particular, packages that are configured to facilitate opening by using the food product to initiate opening of the packages.

SUMMARY

A package containing a food product is provided where the package is configured to facilitate opening by using the food product to initiate opening of the packages. The package includes an outer wrapper with a line of weakness that is generally aligned with or above an upper profile of the food product, which can be, for example, an edge, corner or pair of corners of the food product, such that when the wrapper is pulled against the food product one or more stress concentrations is created along the line of weakness due to the profile of the food product, whether by direct or near direct contact with the line of weakness or by maintaining opposing sides of the wrapper spaced apart during opening. The stress concentrations advantageously facilitates initiation of tearing or rupturing along the line of weakness such that a portion of the package can be completely or at least partially removed to expose at least a portion of the food product. The food product can be directly consumed from the opened package, using the remainder of the package for holding. The food product can be pushed or pulled out of the food package prior to or during consumption. Creation of the stress concentrations can facilitate opening of the food package, which can be particularly convenient for mobile consumption of food products, such as bar or biscuit-type food products which are frequently consumed away from the home or as snacks.

In one aspect, a package containing a food product is provided where the food product has an upper end with an edge profile. The package includes a flexible wrapper enclosing the food product between sealed top and bottom ends and front and rear sides of the wrapper. The wrapper has a line of weakness extending substantially about the front and rear sides, and being generally aligned with or above the edge profile of the upper end of the food product such that, in use, the top end of the package can be pulled away from the front side or and/or bottom end and the edge profile of the food product can facilitate initiation of tearing along the line of weakness to open the package expose the upper end of the food product.

In one aspect, the edge profile of the upper end of the food product can includes a pair of corners. The line of weakness can include a one or more stress concentration discontinuities, such as a pair of stress concentration discontinuities, positioned on the front side of the wrapper and generally aligned with the pair of corners of the edge profile of the upper end of the food product such that, in use, the top end of the package can be pulled away from the front side and/or bottom end and the pair of corners of the food product facilitate initiation of tearing along the line of weakness at the stress concentration discontinuities to open the package expose the upper end of the food product, whether by direct or near direct contact or by maintaining the front and rear sides of the package spaced apart during opening.

In any of the aspects discussed or described herein, there are various forms that the line of weakness can have. For example, the line of weakness can include a segment with a repeating roulette, scalloped or peaked wave pattern, or a more general wave pattern with crests and troughs. Such patterns can advantageously include a crest-to-crest distance or average distance selected to increase the likelihood that the corners or edge profile of the food product will be positioned relative to the line of weakness and, in particular, any stress concentration discontinuities thereof, to facilitate initiation of tearing along the line of weakness at the stress concentration discontinuities to open the package expose the food product. In another example, the line of weakness can include a linear segment extending between the pair of stress concentration discontinuities. The line of weakness can include an inclined a pair of inclined linear segments, each of the inclined linear segments extending from an adjacent one of the pair of stress concentration discontinuities and being inclined toward the bottom end of the package. Each of the pair of inclined linear segments can extend into the rear side of the wrapper.

In any of the aspects discussed or described herein, the rear side of the wrapper can include a fin seal and the line of weakness can include a linear segment adjacent to one or both sides of the fin seal. The line of weakness can include a segment positioned on the fin seal, such as to facilitate separation along the fin seal which can be useful in the case where the top portion of the wrapper is to be removed as opposed to remaining connected, such as by the fin seal.

In any of the aspects discussed or described herein, the food product can be a food stuff in combination with a U-board, backing card or sleeve, such as may be made from paperboard. If present, the U-board, backing card or sleeve can provide added rigidity, such as if the food stuff is fragile or prone to breaking or crumbling. When present, corners or edge or edges of the U-board, backing card or sleeve can be used to facilitate initiation of tearing along the line of weakness at the stress concentration discontinuities to open the package expose the food product.

A method of opening the packages discussed or described herein can include pulling the top end of the package away from the front side or bottom end of the wrapper, creating a stress concentration along a portion of the line of weakness using the edge profile of the upper end of the food product, whether by direct or near direct contact or by maintaining a spaced relationship between opposing walls of the package, to initiate tearing along the line of weakness, and at least partially removing the top end of the package relative to a remainder of the package on an opposite side of the line of weakness to expose the top portion of the food product.

In another aspect, the method of opening the package can include pulling the top end of the package away from the front side or bottom end of the wrapper, creating a stress concentration at at least one of the stress concentration discontinuities with one of the pair of corners of the edge profile of the food product, whether by direct or near direct contact or by maintaining a spaced relationship between opposing walls of the package, to initiate tearing along the line of weakness, and at least partially removing the top end of the package relative to a remainder of the package on an opposite side of the line of weakness to expose the top portion of the food product.

The methods can include completely or partially removing the top end of the package.

DETAILED DESCRIPTION

Figure 1:
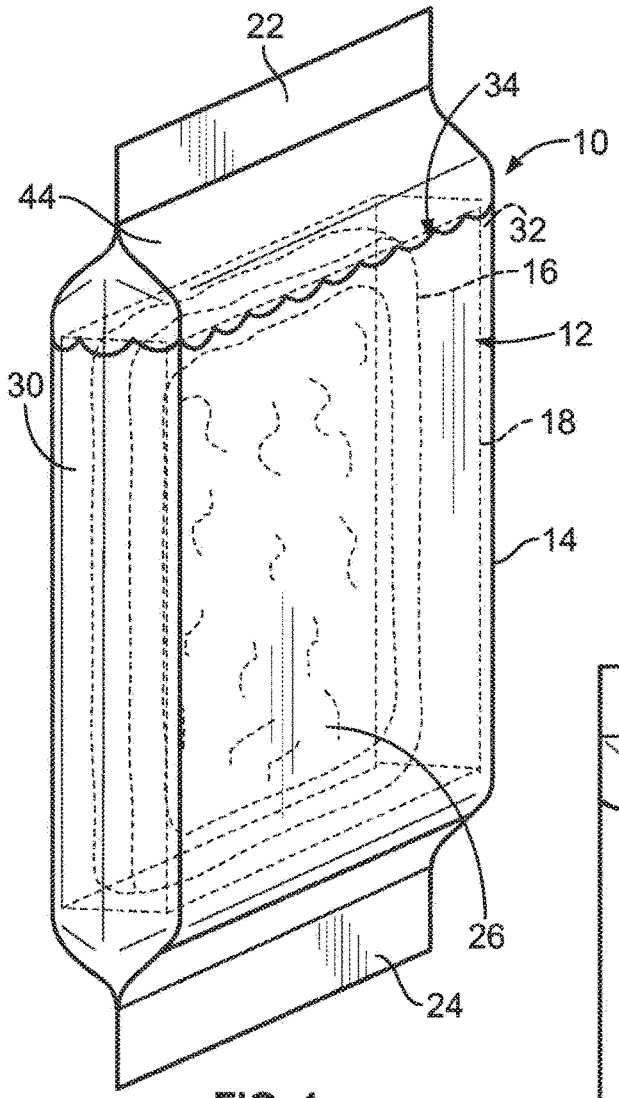
FIG. 1 is a perspective view of a first embodiment of a package containing a food item disposed within a sleeve in turn disposed within a flexible wrapper where the wrapper has a line of weakness with a repeating roulette pattern.
Figure 2:
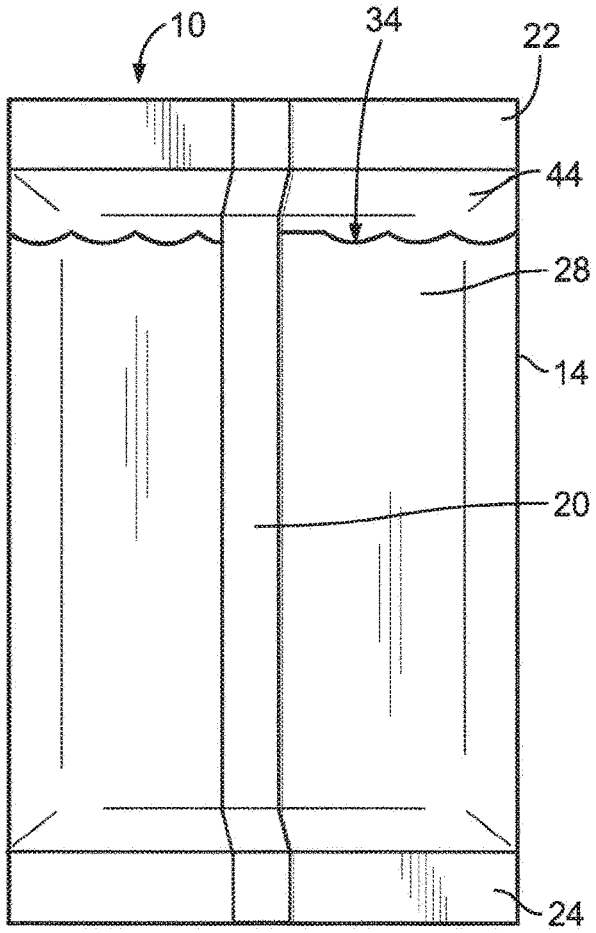
FIG. 2 is a rear elevation view of the package of FIG. 1 and showing a fin seal.
Figure 3:
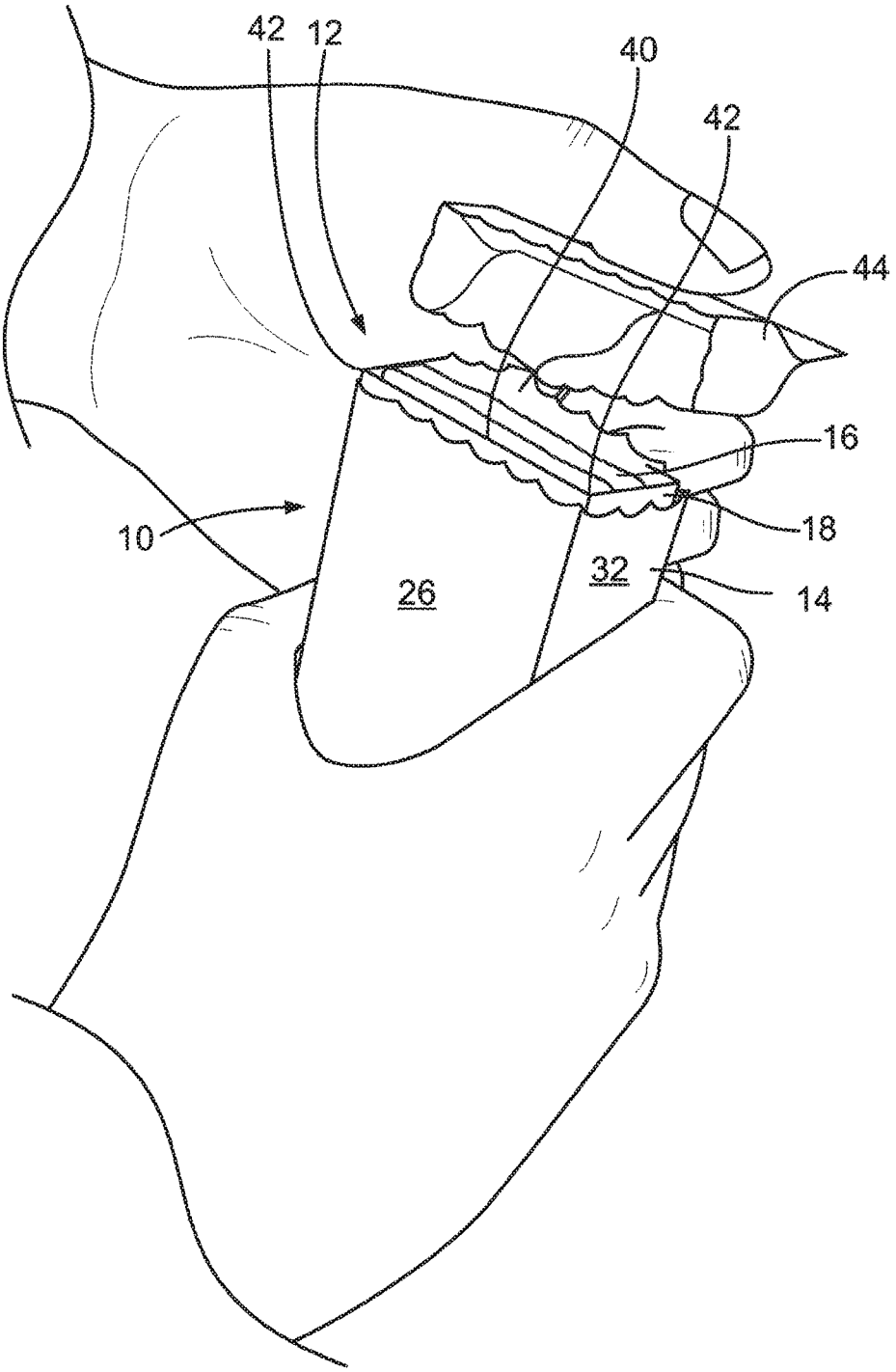
FIG. 3 is a perspective view of the package of FIG. 1 being opened by separating a top portion of the wrapper from the remainder thereof to expose a top end portion of the food item and sleeve.

Packages each containing a food product are described herein and depicted in FIGS. 1-19, where the packages are configured to facilitate opening by using the food product to initiate opening. More specifically, the packages each include an outer wrapper with a line of weakness that is generally aligned with or above an upper profile of the food product. The upper profile of the food product can be, for example, an edge, corner or pair of corners of the food product. When the wrapper is pulled against the food product, one or more stress concentrations are created along the line of weakness due to the profile of the food product, which can be either due to direct or near direct contact with the food product or by the food product spacing opposing walls of the wrapper apart during pulling. The stress concentrations advantageously facilitates initiation of tearing or rupturing along the line of weakness such that a portion of the package can be completely or at least partially removed to expose at least a portion of the food product. As will be explained in greater detail herein, the creation of the one or more stress concentrations can advantageously be facilitated by the optional inclusion of one or more stress concentration discontinuities in the line of weakness. The food product can be directly consumed from the opened package, using the remainder of the package for holding.

In a first exemplary embodiment of the package, and with reference to FIGS. 1-4, the package 10 includes a food product 12 (shown in dashed lines) disposed with a flexible outer wrapper 14. In particular, the food product 12 includes a food item 16, such as an edible bar, disposed within a paperboard sleeve 18. The flexible wrapper 14 is formed into a flow-wrap format, with a longitudinally-extending fin seal 20, shown in FIG. 2, positioned between top and bottom seals 22 and 24 to form an interior with the food product 12 therein. In the illustrated embodiment, the food product 12 has a relatively thin, generally rectangular shape. This imparts a structure to the wrapper 14 resulting in a front panel 26, rear panel 28, and a pair of side panels 30 and 32. The front and rear panels 26 and 28 are sealed to each other, with the side panels 30 and 32 pleated therebetween, to form the top and bottom seals 22 and 24.

Extending substantially about an upper perimeter of the wrapper 14 is a line of weakness 34 having what can be alternatively described as a repeating roulette, scalloped, or crested wave pattern with a curved segment 36 extending between each adjacent pair of crests 38. Advantageously, each of the crests 38 corresponds to a stress concentration discontinuity in the line of weakness 34. Many of the stress concentration discontinuities are present on the front panel 26 of the wrapper 14. The position of the line of weakness 34 and, in particular, the position of the portion of the line of weakness 34 on the front panel 26, is selected so that it generally is aligned with an upper profile 40 of the food product 12; in the illustrated embodiment, the top edge of the sleeve 40. The distance between adjacent pairs of the crests 38 of the line of weakness 34 is selected so that one or preferably both of a pair of corners 42 on a portion of the sleeve 18 adjacent the front panel 26 of the wrapper 14 are aligned with the crests 338. When the top portion 44 of the wrapper 14—the part above the line of weakness 34 and on an opposite side thereof relative to the bottom seal 24—is pulled rearward, toward the rear panel 28, relative to the remainder of the wrapper, the corners 42 and/or the top edge 40 of the sleeve 18 can cause one or more stress concentrations to be formed, preferably though not necessarily at the crests 38, which function as stress concentration discontinuities in the line of weakness 34. This can facilitate ease of removal of the top portion 44 of the package 10 to access the food product 16. There can be bit of play in the location of the food product 16 with the interior of the package 10. Having a relatively short distance between adjacent crests 38 of the line of weakness 34 can increase the likelihood that the corners 42 of the sleeve 18 will align with a pair of crests 38.

Figure 4:
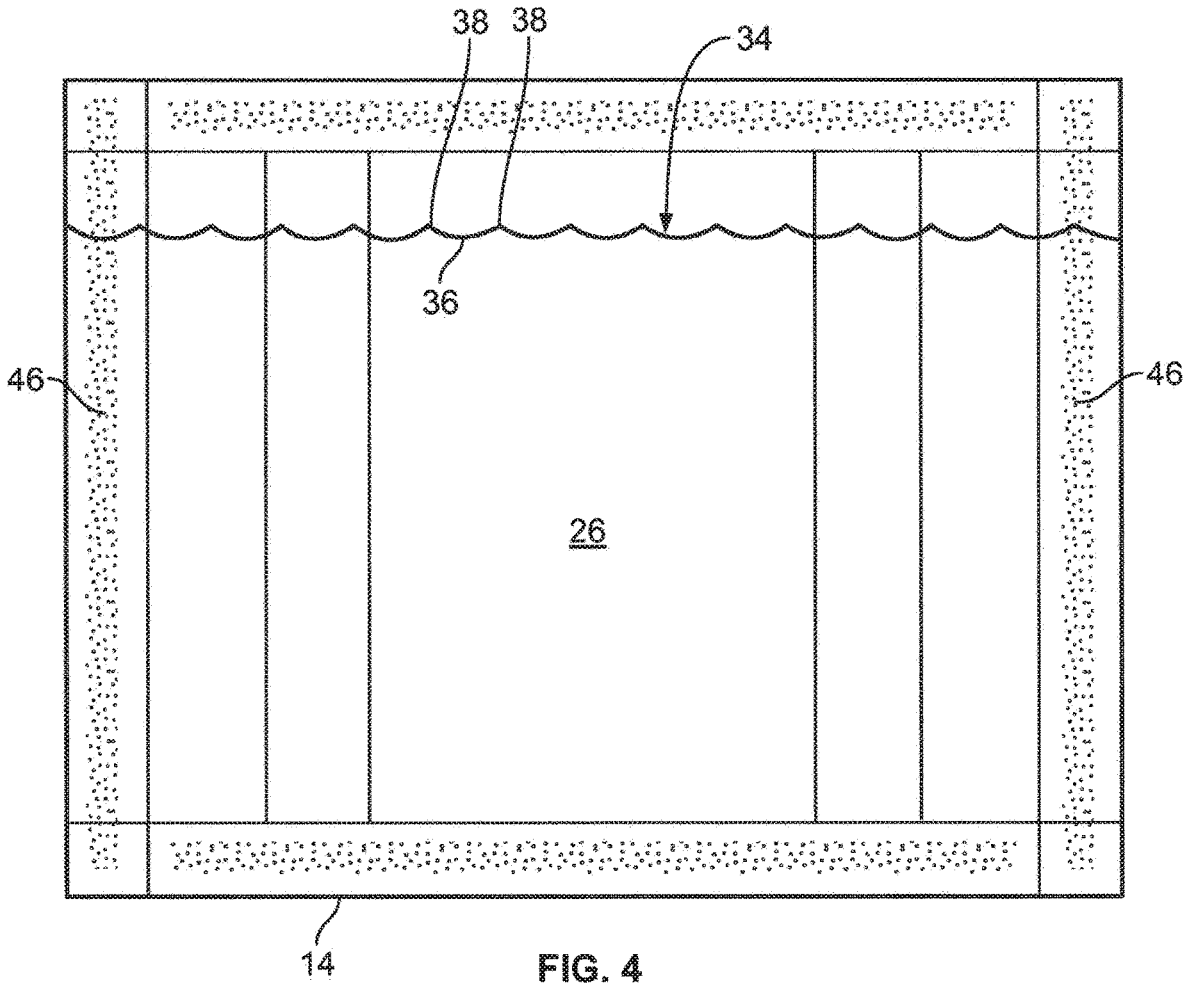
FIG. 4 is a schematic plan view of a flexible wrapper suitable for use in forming the package of FIG. 1.
Figure 5:
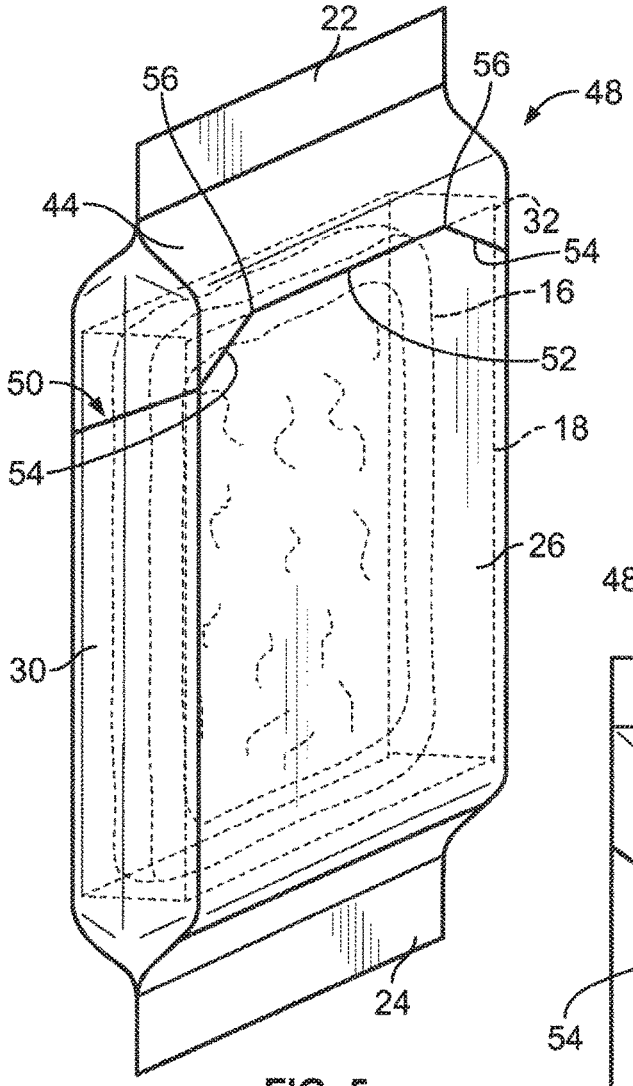
FIG. 5 is a perspective view of a second embodiment of a package containing a food item disposed within a sleeve in turn disposed within a flexible wrapper where the wrapper has a line of weakness with, on a front panel of the wrapper, a stress concentration discontinuity adjacent each end of a central linear segment, and a pair of inclined segments disposed on opposite sides thereof.
Figure 6:
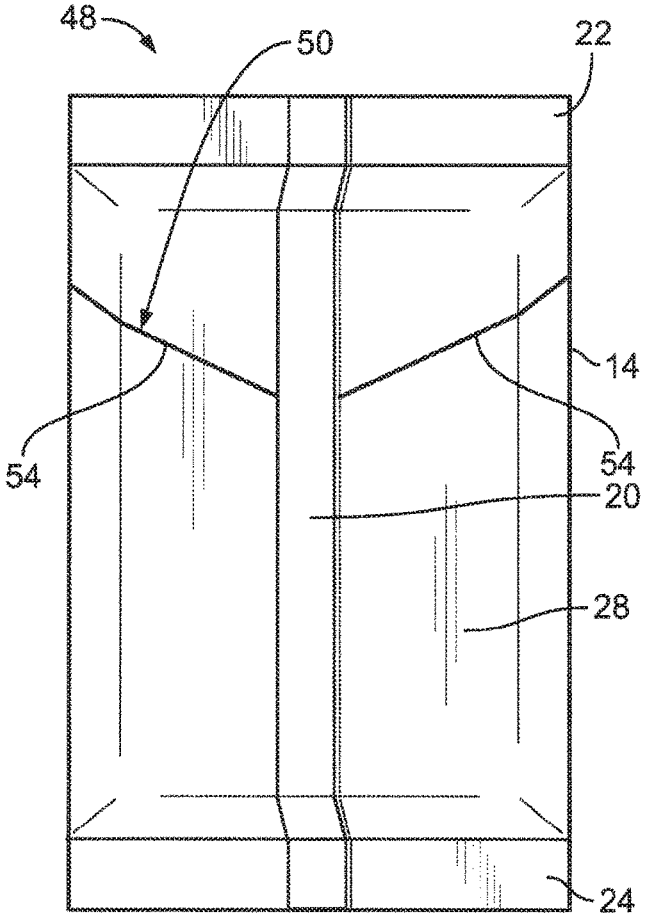
FIG. 6 is a rear elevation view of the package of FIG. 5 and showing a fin seal.
Figure 7:
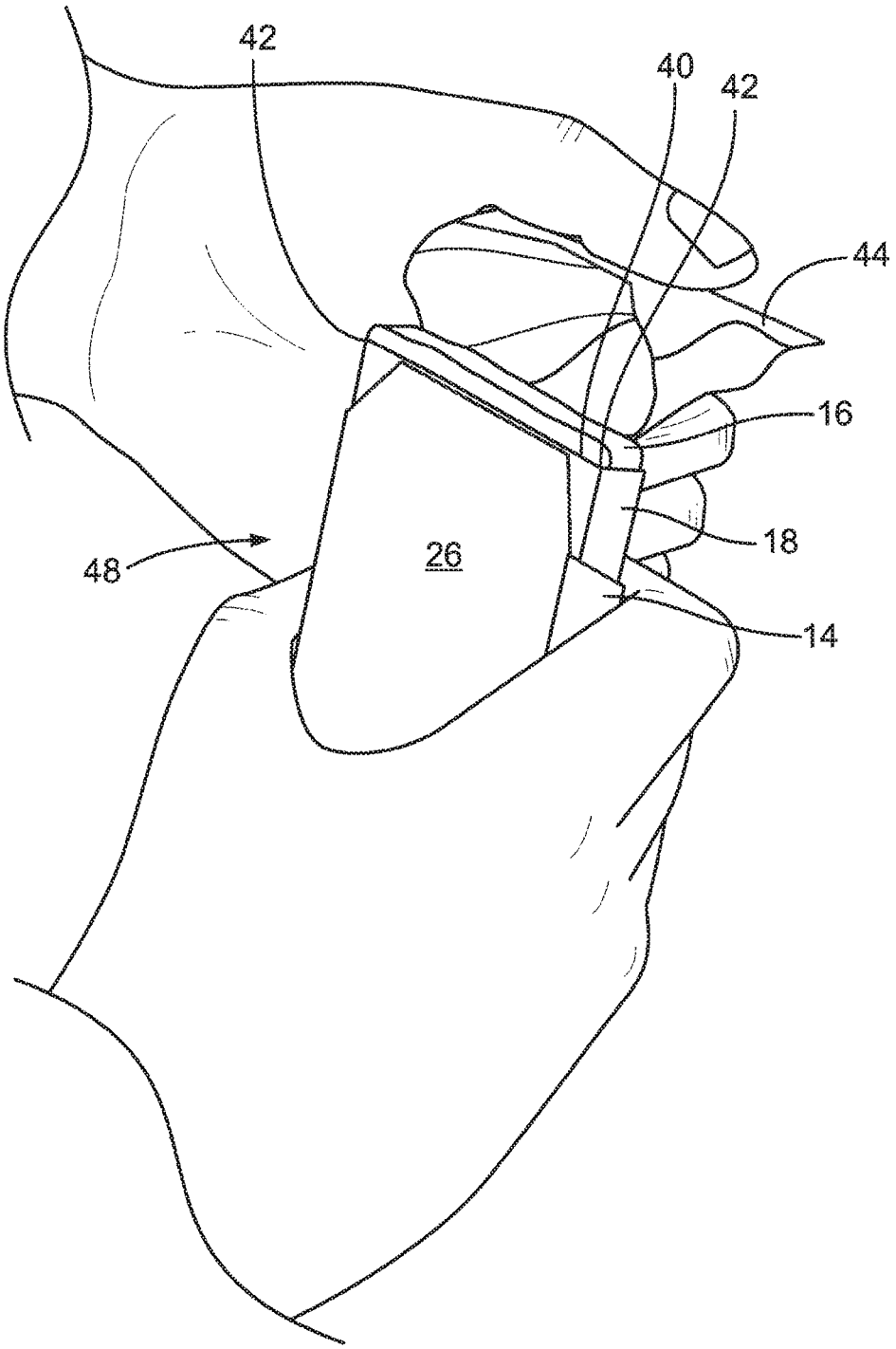
FIG. 7 is a perspective view of the package of FIG. 5 being opened by separating a top portion of the wrapper from the remainder thereof to expose a top end portion of the food item and sleeve.

Turning to details of the line of weakness 34 of the package 10 of the first embodiment, the pattern can continue on the side panels 30 and 32 and rear panel 28 of the package 10 in a continuous manner, and optionally into a pair of longitudinal margins 46 that will be sealed together to form the fin seal 20, as shown in FIG. 4. While illustrated and described as being a repeating pattern, alternatively the pattern can be present only on the front panel 26 or a span thereof that would align with the upper profile of the food product 12. Further, the radius may not be the constant, may not be the same for each portion, and the distance between crests 38 can vary. Also, while the top portion 44 is shown as being completely removed, the line of weakness 34 could alternatively be configured so that the top portion 44 remains partially attached by part of the rear panel 28, such as the fin seal 20.

In a second exemplary embodiment of the package, and with reference to FIGS. 5-8, the package 48 includes a food product 12 disposed with a flexible outer wrapper 14 with the same construction as discussed with reference to the package 10 of the first exemplary embodiment, except as noted herein. That is, the food product 12 includes a food item 16, such as an edible bar, disposed within a paperboard sleeve 18. The flexible wrapper 14 has a longitudinally-extending fin seal 20 positioned between top and bottom seals 22 and 24 to form an interior with the food product 12 therein. The wrapper 14 has an imparted structure resulting in a front panel 26, rear panel 28, and a pair of side panels 30 and 32. The front and rear panels 26 and 28 are sealed to each other, with the side panels 30 and 32 pleated therebetween, to form the top and bottom seals 22 and 24.

The package 48 of the second exemplary embodiment has a different line of weakness pattern 50 as compared to the package 10 of the first exemplary embodiment. More specifically, the line of weakness 50 of the package 48 of the second exemplary embodiment has a central linear segment 52 extending nearly, but not quite all of, the entire width of the front panel 26. At each end of the central linear segment there is an inclined linear segment 54 that extends toward the bottom seal 24 of the wrapper 14. There is a pair of intersections or corners 56 between the central linear segment 52 and the inclined linear segments 54 such that a pair of stress concentration discontinuities is present on the front panel 26 of the package 48. The positions of these stress concentration discontinuities are selected so that they generally are aligned with an upper profile of the food product 12; in the illustrated embodiment, the top edge 40 of the sleeve 18 and the corners 42 of the sleeve 18. When the top portion 44 of the wrapper 14 is pulled rearward, toward the rear panel 28, relative to the remainder of the wrapper 14, the corners 42 and/or the top edge 40 of the sleeve 18 can cause one or more stress concentrations to be formed at the intersections 56 of the central and inclined linear lines 52 and 54. This can facilitate ease of removal of the top portion 44 of the package 48 to access the food product 12.

Figure 8:
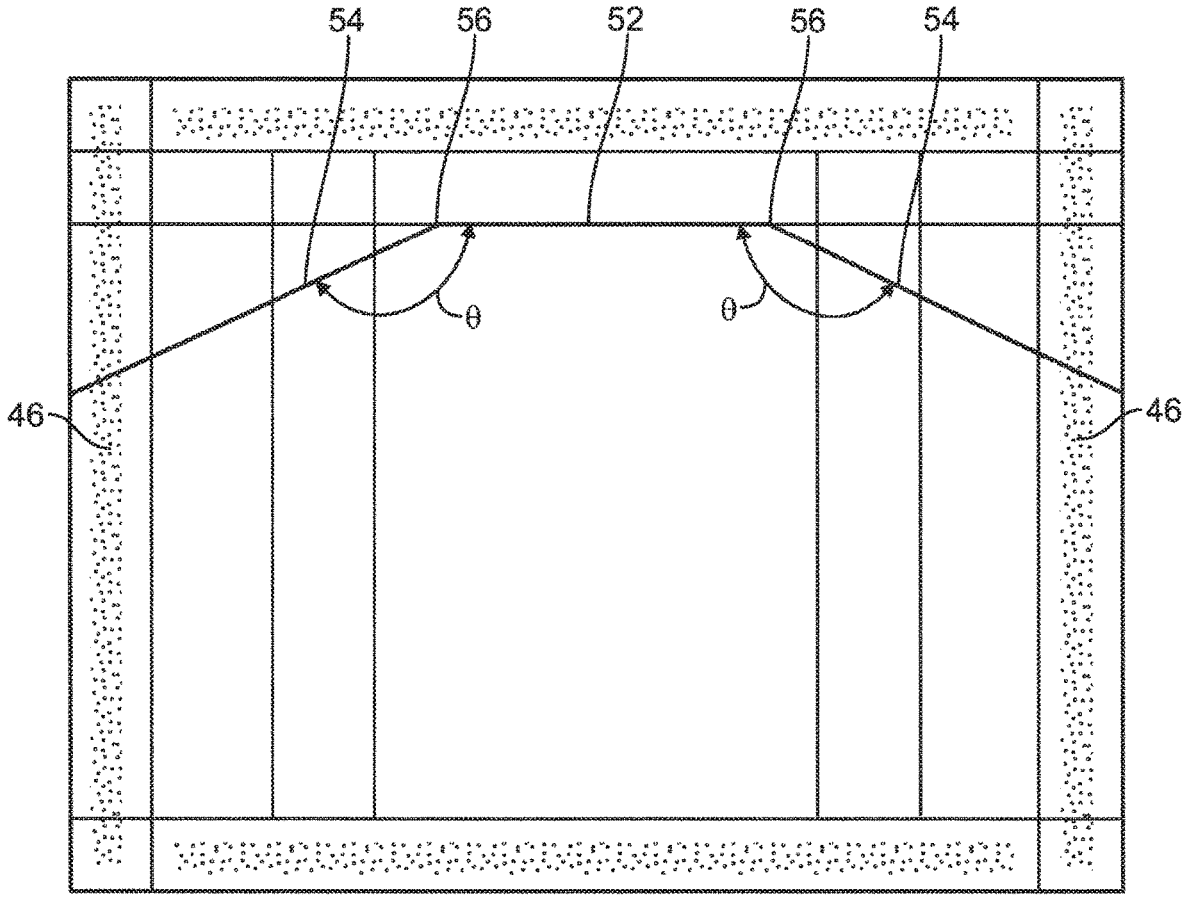
FIG. 8 is a schematic plan view of a flexible wrapper suitable for use in forming the package of FIG. 5.
Figure 9:
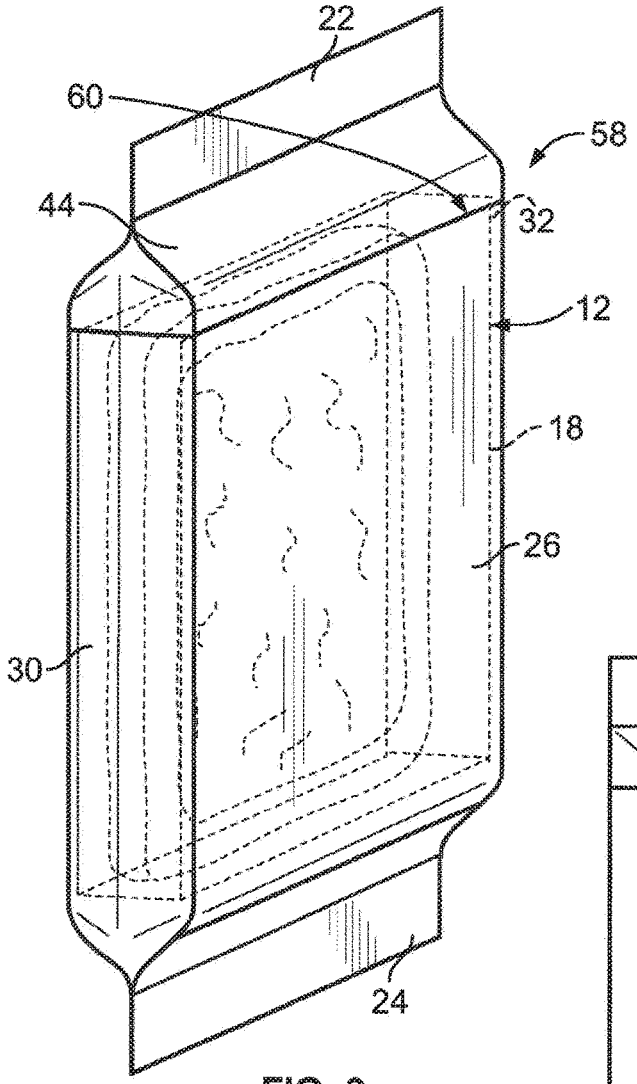
FIG. 9 is a perspective view of a third embodiment of a package containing a food item disposed within a sleeve in turn disposed within a flexible wrapper where the wrapper has a linear line of weakness.
Figure 10:
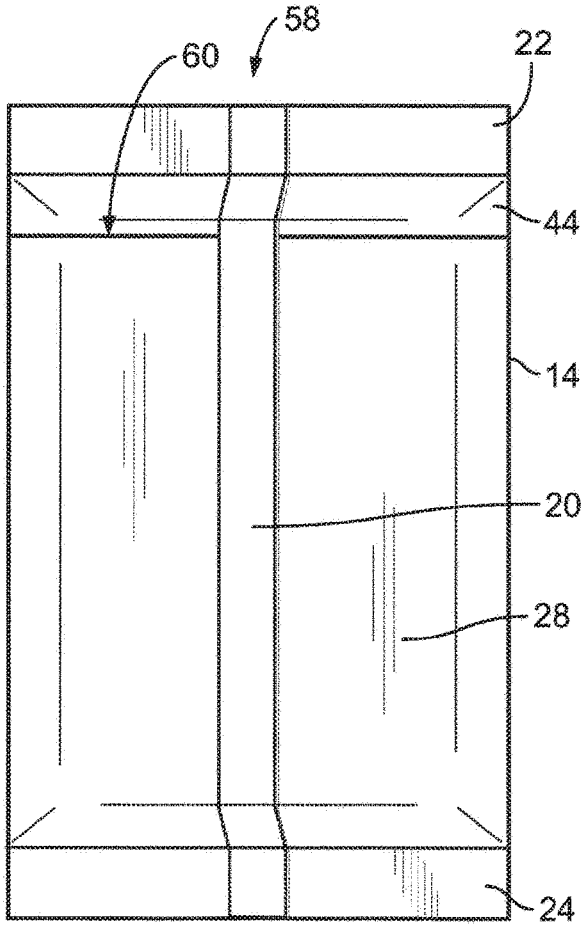
FIG. 10 is a rear elevation view of the package of FIG. 9 and showing a fin seal.
Figure 11:
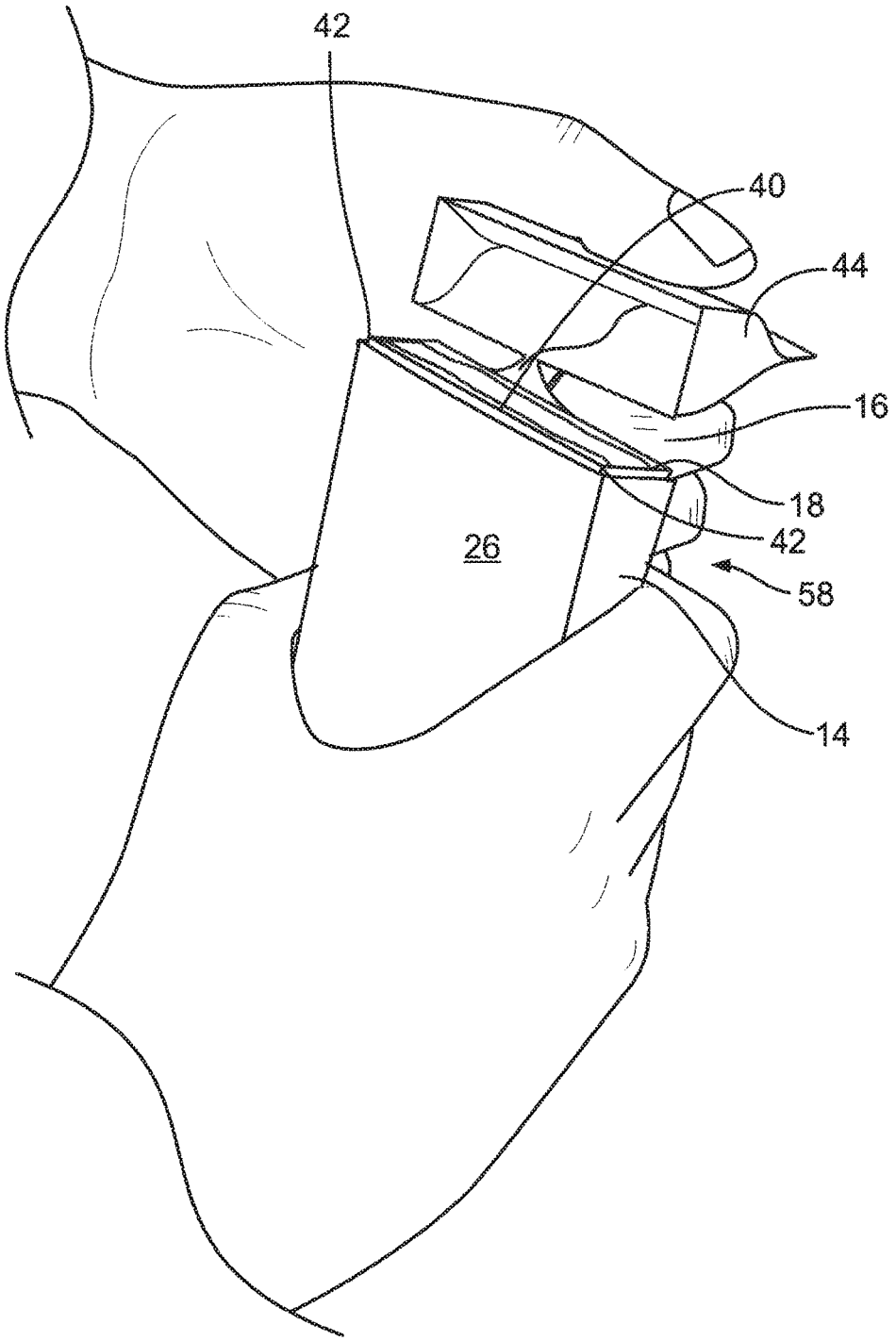
FIG. 11 is a perspective view of the package of FIG. 9 being opened by separating a top portion of the wrapper from the remainder thereof to expose a top end portion of the food item and sleeve.

Turning to details of the line of weakness 50 of the package 48 of the second embodiment, the central linear segment 52 can have a length of between about 75 and 95% of the front panel 26, and the inclined linear segments 54 can have an angle θ of between about 15 and 60 degrees. The inclined linear segments 54 can continue on the side panels 30 and 32 and rear panel 28 of the package 48 in a continuous manner, and optionally into a pair of longitudinal margins 46 that will be sealed together to form the fin seal, as shown in FIG. 8. While illustrated as being multiple linear segments 52 and 54, each segment could instead be curved or have multiple curves, and can optionally include a variety of different patterns. Also, while the top portion 44 is shown as being completely removed, the line of weakness 50 could alternatively be configured so that the top portion 44 remains partially attached by part of the rear panel 28, such as the fin seal 20, as mentioned above with respect to the first exemplary embodiment.

The third exemplary embodiment of the package, illustrated in FIGS. 9-12, has yet another alternative line of weakness pattern as compared to those of the packages 10 and 48 first and second exemplary embodiments. The package 58 includes a food product 12 disposed with a flexible outer wrapper 14 with the same construction as discussed with reference to the first and second exemplary embodiments, except as noted herein. Briefly, the flexible wrapper 14 has a longitudinally-extending fin seal 20 positioned between top and bottom seals 22 and 24 to form an interior with the food product 12 therein. The wrapper 14 has an imparted structure resulting in a front panel 26, rear panel 28, and a pair of side panels 30 and 32. The front and rear panels 26 and 28 are sealed to each other, with the side panels 30 and 32 pleated therebetween, to form the top and bottom seals 22 and 24.

The line of weakness is a linear line 60 that extends substantially about the perimeter of the wrapper 14 near the upper end thereof in orientation generally parallel to the top seal 22. The linear line 60 is positioned such that the upper profile of the food product 12 can be used to press against a segment of the linear line 60 on the front panel 28 as the top portion 44 of the wrapper 14 is pulled rearward. Alternatively, the linear line 60 can be positioned above the upper profile of the food product 12 such that the food product 12 can space the front and rear sides of the wrapper apart during pulling of the top end. This can create a stress concentration along the line of weakness and, in particular, adjacent the corners 42 of the sleeve 18 and/or along the edge 40 of the sleeve 18, to facilitate partial or complete removal of the top portion 44 of the package.

Figure 14A:
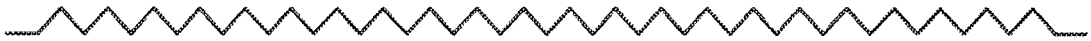
FIG. 14A is a schematic plan view of a fifth embodiment of a line of weakness that can be incorporated into the flexible wrapper and package discussed herein.
Figure 14B:
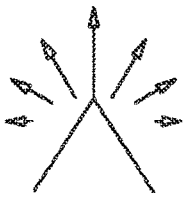
FIG. 14B is a schematic representative of opening force vectors along a crest of the line of weakness of FIG. 14A.
Figure 14C:
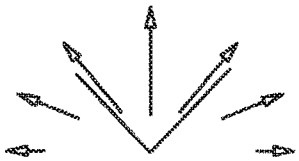
FIG. 14C is a schematic representative of opening force vectors along a trough of the line of weakness of FIG. 14A.
Figure 15:
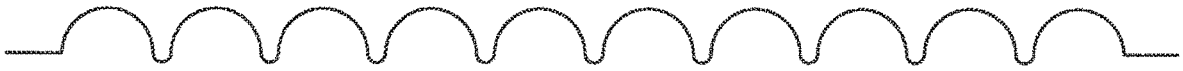
FIG. 15 is a schematic plan view of a sixth embodiment of a line of weakness that can be incorporated into the flexible wrapper and package discussed herein.
Figure 16:
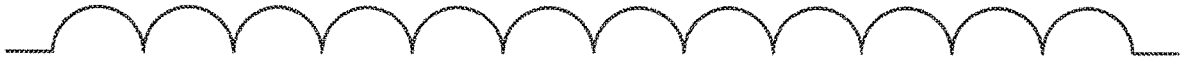
FIG. 16 is a schematic plan view of a seventh embodiment of a line of weakness that can be incorporated into the flexible wrapper and package discussed herein.
Figure 17:
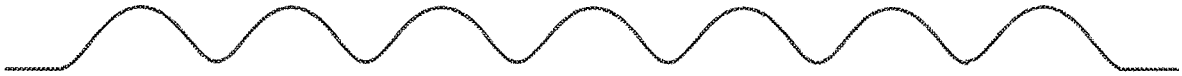
FIG. 17 is a schematic plan view of a eighth embodiment of a line of weakness that can be incorporated into the flexible wrapper and package discussed herein.

Other exemplary alternative patterns for the line of weakness are illustrated in FIGS. 13-17. The pattern of FIG. 13A can be described as a general wave pattern with a series of crests and troughs. The crests can each optionally have a larger radius, such as between about 2.5 and 3 times larger, than the radius of each of the troughs. This can advantageously put more force at the tops of the peaks which can lead to less force being required to initiate rupturing of the line of weakness. The wave pattern of FIG. 14A includes sharp points instead of curved radii. The wave pattern of FIG. 17 illustrates a smaller density of crests and troughs as compared to the example of FIG. 13A. Variations of the repeating roulette pattern are illustrated in FIGS. 15 and 16. Unlike the pattern of the first embodiment, these alternative roulette patterns are inverted such that the crests have a large, smooth radius compared to the much smaller (FIG. 15) or even pointed (FIG. 16) troughs.

Without being bound by theory, it is believed that axially pulling on the end of the packages having the non-linear lines of weakness described herein will generate what can be characterized as centripetal forces and centrifugal forces. The centrifugal forces are believed to contribute more to initiating rupturing of the line of weakness, and the centripetal forces are believed to contribute more to propagating the rupturing along the line of weakness.

Figure 12A:
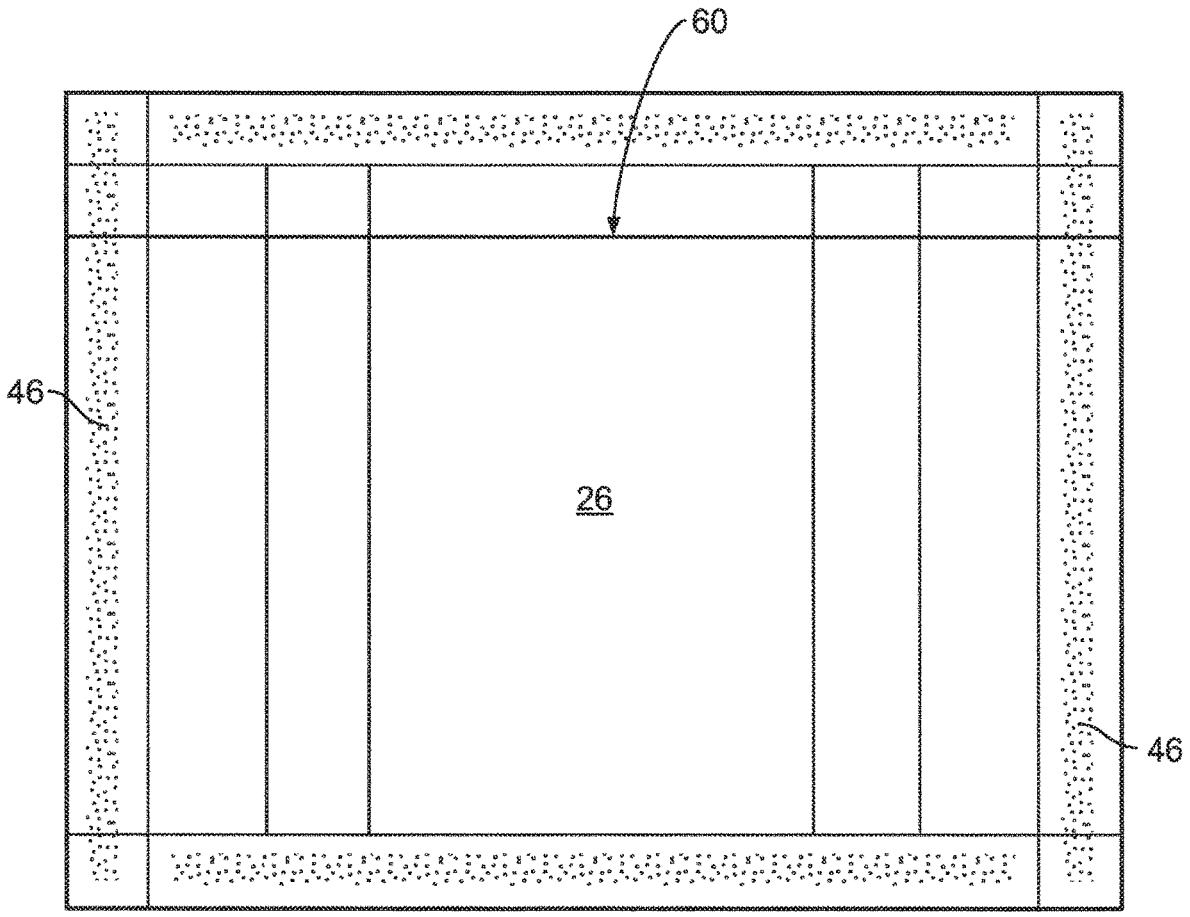
FIG. 12A is a schematic plan view of a flexible wrapper suitable for use in forming the package of FIG. 9.
Figure 12B:
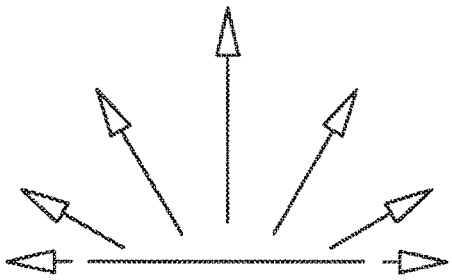
FIG. 12B is a schematic representative of opening force vectors along a segment of the linear line of weakness of FIG. 9.

With reference to a schematic representation of FIG. 12B showing forces acting on the linear line of weakness, the greater or dominant force vector is in the middle and is perpendicular to the linear line of weakness. Other force vectors decrease closer to being parallel to the linear line of weakness. This results in comparatively smaller, dominant force vectors parallel to the linear line of weakness and at about 90 degrees to the dominant force vector for initiating tearing. The cumulative impact of these force vectors is that the largest force vector is perpendicular to the linear line of weakness and thus most likely to initiate rupturing, but the smaller force vectors parallel to the linear line of weakness result in a less force being used for propagating the rupturing, and thus requiring overall greater pulling forces to both initiate and propagate rupturing. While such a linear line of weakness can function, particularly if positioned according to the principals discussed below with reference to FIGS. 18 and 19, other patterns discussed herein can require less overall force to both initiate and propagate rupturing.

Figure 13A:
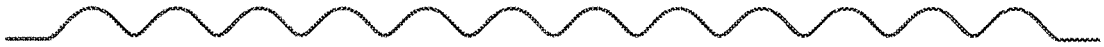
FIG. 13A is a schematic plan view of a fourth embodiment of a line of weakness that can be incorporated into the flexible wrapper and package discussed herein.
Figure 13B:
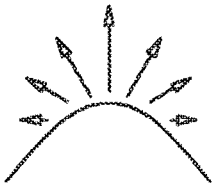
FIG. 13B is a schematic representative of opening force vectors along a crest of the line of weakness of FIG. 13A.
Figure 13C:
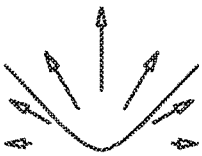
FIG. 13C is a schematic representative of opening force vectors along a trough of the line of weakness of FIG. 13A.

In contrast to the linear line of weakness discussed above, the general wave pattern of FIG. 13A can take advantage of the centrifugal forces to initiate the rupturing, and the centripetal forces to propagate rupturing. More specifically, as shown in FIG. 13B the dominant centrifugal force vectors facilitate initial rupturing, with several dominant force vectors (such as the three middle vectors) being perpendicular to or nearly perpendicular to the crest of the line of weakness. To facilitate propagation, as shown in FIG. 13C, the valley or trough has large, resultant, dominant centripetal force vectors that are parallel to or close to parallel to the line (such as the middle two vectors on the left and right of the center vector). Further, it is believed that the curves of the troughs and crests contribute to the redirect of forces as the tear follows the line of weakness, thereby avoiding a stop whereby forces could have a more difficult time changing direction. The line of weakness of FIG. 14A similarly takes advantage of the dominant, centrifugal force vectors to initiate rupturing, as shown in FIG. 14B, and of the dominant, centripetal forces to facilitate propagation, as shown in FIG. 14C. However, the sharp crests and troughs of the line of weakness of FIG. 14A can function as stops to the propagation, thereby hindering propagation as compared to the line of weakness of FIG. 13A having larger radii for the crests and troughs.

Figure 18:
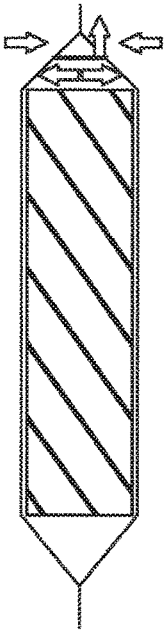
FIG. 18 is a schematic cross-section view of a package incorporated a line of weakness above the upper end of the food product and showing representative force vectors resulting from pulling the top and bottom of the package axially apart.
Figure 19:
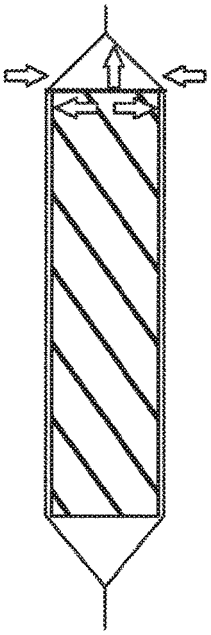
FIG. 19 is a schematic cross-section view of a package incorporated a line of weakness at the upper end of the food product and showing representative force vectors resulting from pulling the top and bottom of the package axially apart.
Figure 20:
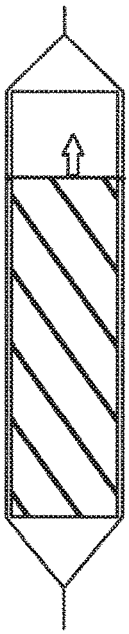
FIG. 20 is a schematic cross-section view of a package incorporated a line of weakness far below the upper end of the food product and showing representative force vectors resulting from pulling the top and bottom of the package axially apart.

Also, without being bound by theory, it is believed that positioning the line of weakness either at or near the edge profile of the food product, as shown in FIG. 18, or above the edge profile of the food product, as shown in FIG. 19, can advantageously lead to beneficial and counteracting force vectors when the top end of the package is pulled to open the package. These beneficial force vectors can cooperate with the stress concentration discontinuities, if preset, to further facilitate initial rupturing, such as by shearing, of the line of weakness. When the line of weakness is above edge profile of the food product, as shown in FIG. 18, the food product can assist in spacing the opposing walls of the package during pulling, such that force vectors with outward components below the line of weakness and inward components above the line of weakness can result to facilitate initiation of rupturing. Similarly, when the line of weakness is generally aligned with the edge profile of the food product, as shown in FIG. 19, vectors with inward components above the line of weakness and outward components below the line of weakness are generated to facilitate initiation of rupturing. These beneficial force vectors are in contrast to an arrangement where the line of weakness is far below the edge profile of the food product, as shown in FIG. 20, where such vectors are absent. Instead, predominately upward vectors could result, which do not achieve the beneficial shearing believed to result from having the line of weakness either at or close to the top of the food product or thereabove, as shown in FIGS. 19 and 18, respectively.

Although a paperboard sleeve 18 is described and illustrated as being disposed about the food item, the sleeve could be formed of other suitable materials, substituted with a three sided paperboard support or U-board (having either a front or rear panel and a pair of upstanding side panels) or a simple backing card, or only the food item may be present. While some softer or more crumbly food items could benefit from the use of sleeve or backing card, other food products that are more rigid may omit a sleeve or backing card. The term "food product," as used herein, is meant to include the food item, that is, an edible food stuff, as well as associated packaging within the wrapper, such as the sleeve or backing card if present.

In any of the foregoing embodiments, the line of weakness can be formed using a laser, mechanical dies, blades or the like. The line of weakness can be a partial depth score line, a perforation pattern with either full or partial depth cuts, combinations thereof, or other suitable weakness in the wrapper. The wrapper can be formed from an OPP (orientated polypropylene)-adhesive-OPP laminate, with the line of weakness extending through the outer layer of OPP and partially into the inner layer of OPP.

While preferred embodiments have been described in detail, variations and modifications can be effected within the configurations described herein. For example, various features of the different lines of weaknesses described herein can be combined.

The invention claimed is:

1. A package containing a food product having an upper end with an edge profile, the edge profile including a pair of corners, the package comprising:

a flexible wrapper enclosing the food product between sealed top and bottom ends and side panels and front and rear sides;

the wrapper having a linear line of weakness continuously extending about a perimeter of the wrapper across the front and rear sides and along the side panels;

the linear line of weakness being generally aligned with the edge profile of the upper end of the food product;

the linear line of weakness including portions generally aligned with the pair of corners of the edge profile of the upper end of the food product;

wherein the top end of the package is configured to be pulled away from the front side of the wrapper; and wherein the pair of corners of the food product facilitate initiation of tearing of the flexible wrapper along the portions of the linear line of weakness generally aligned with the pair of corners of the edge profile of the upper end of the food product to open the package and expose the upper end of the food product.

2. The package of claim 1, wherein the food product comprises a food stuff in combination with a U-board or a sleeve.

* * * * *